US007050543B2

(12) United States Patent
Frank

(10) Patent No.: US 7,050,543 B2
(45) Date of Patent: May 23, 2006

(54) MICROFOCUS X-RAY TUBE

(75) Inventor: Udo Emil Frank, Hannover (DE)

(73) Assignee: Feinfocus Röntgen-Systeme GmbH, (DE)

( * ) Notice: Subject to any disclaimer, the term of this patent is extended or adjusted under 35 U.S.C. 154(b) by 60 days.

(21) Appl. No.: 10/702,219

(22) Filed: Nov. 5, 2003

(65) Prior Publication Data

US 2004/0091081 A1 May 13, 2004

(30) Foreign Application Priority Data

Nov. 6, 2002 (DE) ..... 102 51 635

(51) Int. Cl.
*H01J 35/08* (2006.01)

(52) U.S. Cl. ..... 378/143; 378/119; 378/121

(58) Field of Classification Search ..... 378/64, 378/65, 119, 121, 137, 138, 143, 147, 136
See application file for complete search history.

(56) References Cited

U.S. PATENT DOCUMENTS

| | | | | | |
|---|---|---|---|---|---|
| 1,717,309 | A | | 6/1929 | Bouwers | 378/121 |
| 3,584,219 | A | | 6/1971 | Herglotz et al. | 250/399 |
| 3,668,454 | A | | 6/1972 | Shimura | 378/136 |
| 4,159,437 | A | | 6/1979 | Sahores | 378/140 |
| 4,229,657 | A | * | 10/1980 | Bensussan et al. | 378/125 |
| 4,439,870 | A | * | 3/1984 | Poulsen et al. | 378/143 |
| 4,521,902 | A | * | 6/1985 | Peugeot | 378/138 |
| 4,618,972 | A | | 10/1986 | Georgiou et al. | 378/34 |
| 4,825,454 | A | * | 4/1989 | Annis et al. | 378/87 |
| 4,857,730 | A | * | 8/1989 | Pierre | 250/305 |
| 4,870,671 | A | | 9/1989 | Hershyn | 378/124 |
| 4,969,173 | A | * | 11/1990 | Valkonet | 378/136 |
| 5,422,926 | A | * | 6/1995 | Smith et al. | 378/121 |
| 5,729,583 | A | | 3/1998 | Tang et al. | 378/122 |
| 5,940,469 | A | * | 8/1999 | Hell et al. | 378/143 |
| 6,075,839 | A | * | 6/2000 | Treseder | 378/140 |
| 6,195,411 | B1 | * | 2/2001 | Dinsmore | 378/65 |
| 6,385,294 | B1 | * | 5/2002 | Suzuki et al. | 378/136 |
| 6,487,272 | B1 | | 11/2002 | Kutsuzawa | 378/140 |
| 6,661,876 | B1 | * | 12/2003 | Turner et al. | 378/138 |
| 6,778,633 | B1 | * | 8/2004 | Loxley et al. | 378/113 |
| 6,826,254 | B1 | * | 11/2004 | Mihara et al. | 378/64 |
| 2003/0108155 | A1 | * | 6/2003 | Wilkins et al. | 378/119 |

FOREIGN PATENT DOCUMENTS

| | | |
|---|---|---|
| DE | 662 408 | 6/1938 |
| DE | 3139899 | 4/1983 |

(Continued)

*Primary Examiner*—Allen C. Ho
(74) *Attorney, Agent, or Firm*—Robert W. Becker & Associates; Robert W. Becker

(57) ABSTRACT

A microfocus X-ray tube is provided, and comprises a head that during operation of the X-ray tube faces an object that is to be inspected. The head has an outer surface with a cross-section that tapers toward a free end of the head. A target is disposed on or in the head. A mechanism is provided for forming an electron beam adapted to bombard the target, and forms the electron beam such that the X-ray tube has a focus with a diameter of ≦200 μm. The target has an outer surface with a cross-section that tapers toward an end of the target that during the operation of the X-ray tube faces an object that is to be inspected. A collimator can be provided for the target and also has an outer surface with a cross-section that tapers toward an end of the collimator that during operation of the X-ray tube faces an object that is to be inspected.

7 Claims, 2 Drawing Sheets

FOREIGN PATENT DOCUMENTS

| | | |
|---|---|---|
| DE | 196 33 860 | 2/1997 |
| EP | 0292055 | 11/1988 |
| EP | 0 77 255 | 6/1997 |
| EP | 0777255 | 6/1997 |
| GB | 1249341 | 10/1971 |
| JP | 09082252 | 3/1997 |
| WO | WO 01/99478 | 12/2001 |

* cited by examiner

MICROFOCUS X-RAY TUBE

BACKGROUND OF THE INVENTION

The present invention relates to a microfocus X-ray tube for inspecting an object.

Microfocus X-ray tubes are known, and are used, for example, for inspecting printed circuit boards in the electronics industry. The known X-ray tubes have a head that during operation of the X-ray tubes faces an object that is to be inspected, with a target being disposed on or in the head and being adapted to be bombarded with high energy accelerated electrons, so that in a manner known per se X-ray radiation is emitted. The thus produced X-ray radiation is used in imaging processes in order, for example, to illustrate components or component arrangements on printed circuit boards, and to optically inspect the printed circuit boards in this manner.

Microfocus X-ray tubes are known, the head of which, which during operation faces the object that is to be inspected, has a diameter of several cm. To achieve a great enlargement, it is necessary to bring the focus, and hence the head of the microfocus X-ray tube close enough to the component that is to be inspected. This is possible only if no raised portions are present on the component that is to be inspected and against which the head bufts prior to reaching the required spacing. The known X-ray tubes are thus predominantly suitable for inspecting flat components, whereas they are suitable to only a limited extent for inspecting components that have raised portions, for example loaded circuit boards.

To avoid this drawback, it is known to form the head of the X-ray tubes by a so-called rod anode that is formed by a cylindrical tube having a diameter of only a few cm to a few mm. In particular if the rod anode that is utilized has a diameter of only a few mm, it is possible with such X-ray tubes to also penetrate into narrow depressions, recesses or hollow spaces of a component that is to be inspected.

However, a drawback of such X-ray tubes is that the rod anodes that are used are not very stable, and are therefore sensitive to mechanical damage. To prevent mechanical damage of the rod anodes due to abutment against the component that is to be inspected, it is necessary to carry out the approach of the rod anode to the component that is to be inspected accompanied by optical observation, which requires a high outlay for apparatus and is hence expensive. Furthermore, an optical control of the approach of the rod anode to the component that is to be inspected requires a lot of time and hence results in high personnel costs.

For this reason, it is desirable in practice to use large diameter rod anodes that are not sensitive to mechanical damage.

However, if the head with its flat side, to achieve an inclined radiation through a component that is to be inspected, cannot be brought to the component parallel to its surface, but rather only at an angle to this surface, the drawback is that the danger exists that due to raised portions that are present on the surface, the head cannot be brought close enough to a location of the component that is to be inspected.

It is therefore an object of the present invention to provide a microfocus X-ray tube with which it is also possible to inspect components that are jagged or full of fissures, and which X-ray tube has a robust construction.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
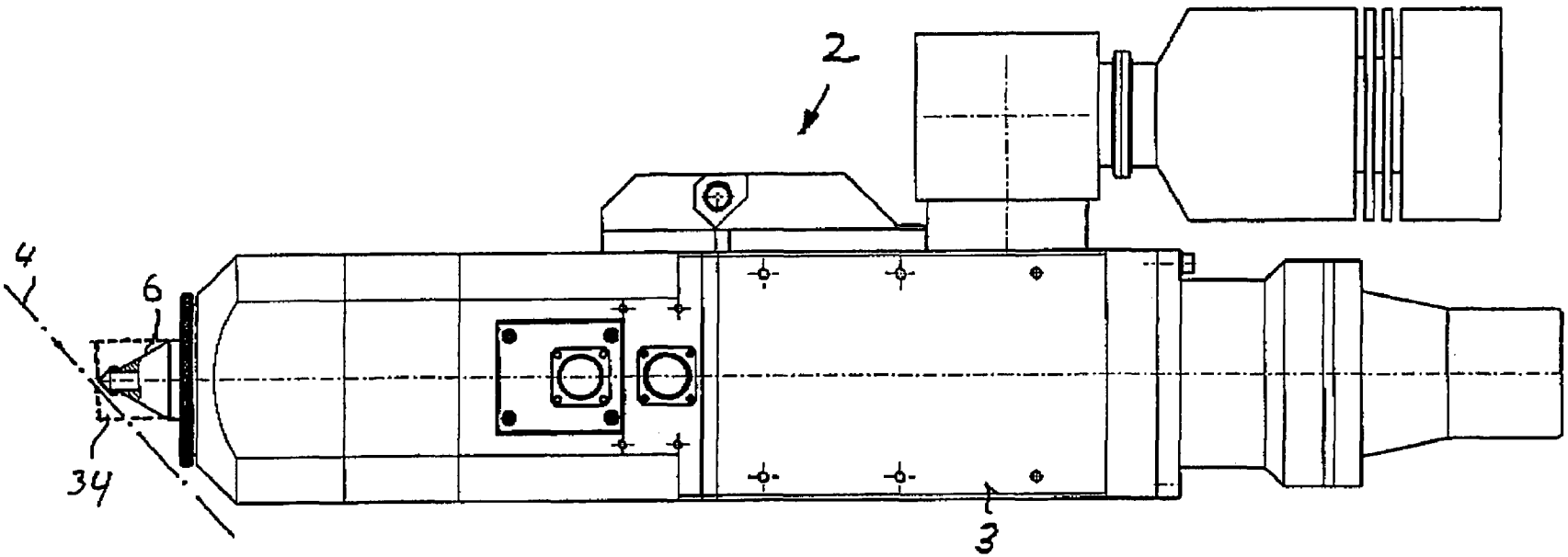
FIG. 1 is a side view of one exemplary embodiment of an inventive microfocus X-ray tube.

The microfocus X-ray tube of the present application comprises a head that during operation of the X-ray tube faces an object that is to be inspected, wherein the head has an outer surface with a cross-section that tapers toward a free end of the head; a target disposed on or in the head; and means for forming an electron beam adapted to bombard the target, wherein the means form the electron beam such that the X-ray tube has a focus with a diameter of $\leqq 200$ μm, especially $\leqq 10$ μm.

The present invention realizes the aforementioned object in a surprisingly simple manner by having the outer surface of the head be provided with a cross-section that tapers toward the free end of the head. In this way it is achieved that the head on the one hand has small dimensions at its free end, which is advantageous for inspecting components that are full of fissures, but on the other hand, at its end that is remote from the free end and where the head is connected with the main body of the X-ray tube, the head has an adequately large base to make the head insensitive to mechanical damage, for example when butting against a component that is to be inspected. The taper of the cross-section of the outer surface toward the free end of the head makes it possible to also bring the head toward the component at an angle to the surface thereof, whereby as far as possible this prevents portions of the outer surface of the head that are remote from its free end from butting against the surface that is to be inspected. Thus, the inventive teaching makes it possible to bring the head of the X-ray tube very close to the location of the component that is to be inspected, even with an inclined irradiation of the component that is to be inspected, so that with the inventive microfocus X-ray tube very high enlargement factors can be achieved.

Pursuant to the present application, the term head of the X-ray tube means the free end thereof that during operation of the microfocus X-ray tube faces the component that is to be inspected.

The inventive microfocus X-ray tube is robust or sturdy in construction, and is insensitive to mechanical damage, for example when butting against a component that is to be inspected. The X-ray tube has multi-purpose uses and is particularly suitable for the inspection of printed circuit boards in the electronics industry.

A further advantage of the inventive microfocus X-ray tube is that it is simple and economical to manufacture.

Within the context of the present application, the term microfocus X-ray tube refers to X-ray tubes having a focus with a diameter of ≦200 μm, especially ≦10 μm.

The taper of the cross-section of the outer surface of the head can be embodied in any suitable manner. For example, the free end of the head can be embodied in the manner of a tapered, ridged roof. An advantageous further development of the inventive teaching provides that the outer surface is essentially rotationally symmetrical. With this embodiment, a particularly economical construction is achieved, since the outer surface of the head can be formed, for example, by a simple turned piece.

With the aforementioned embodiment, the outer surface expediently has an essentially conical configuration, as is provided by a further development. In this way, manufacture of the head is further simplified.

Pursuant to another further development of the inventive teaching, the outer surface of the head terminates in a vertex. This embodiment is advantageous to the extent that the vertex can also be introduced into smaller diameter recesses on a component that is to be inspected in order to undertake inspection of such recesses.

Pursuant to another advantageous further development of the inventive teaching, the outer surface of the head is formed by the target.

Pursuant to another further development, the outer surface is formed by a collimator that is disposed ahead of the target in the direction of irradiation of the X-ray radiation.

In conformity with the respective requirements, the outer surfaces of the head, in the direction of radiation, can also be formed, at least in part, by a holder for the target.

With the embodiment having the essentially conical outer surface, the opening angle of the essentially conical outer surface is preferably less than 50°. In this way, the head can also be brought at a steep incline to the surface of the component that is to be inspected.

Pursuant to another further development, the head has at least two regions, which are disposed one after the other in the irradiation direction of the X-ray radiation, and which have different opening angles of the conical surface. With this embodiment, in the direction of irradiation of X-ray radiation, the head is composed of cones having different opening angles.

The target is expediently a transmission target, as is provided by another further development.

The target of the present application can have an outer surface that has a cross-section that tapers toward an end of the target that during operation of an X-ray tube faces an object that is to be inspected. The outer surface of the target is expediently essentially symmetrical, is essentially conical, or opens into a vertex.

An inventive collimator for a target of a microfocus X-ray tube can have an outer surface having a cross-section that tapers toward an end of the collimator that during the operation of an X-ray tube faces an object that is to be inspected. Here too the outer surface is expediently essentially rotationally symmetrical, essentially conical, or opens into a vertex. Furthermore, the collimator can have a continuous opening that extends in the irradiation direction of the X-ray radiation.

Further specific features of the invention will be described in detail subsequently.

Description of Preferred Embodiments

Referring now to the drawings in detail, illustrated in FIG. 1 is one embodiment of an inventive microfocus X-ray tube 2 which, at its end that during operation of the microfocus tube 2 faces a component that is to be examined or inspected, and that in FIG. 1 is symbolized by a dot—dash line 4, is provided with a head 6 in which is disposed a target in a manner that will be described in greater detail subsequently. The microfocus X-ray tube 2, which in the following will be designated by the abbreviation X-ray tube, is furthermore provided with means for accelerating electrons and for directing the electron onto the target; such means, which are not shown in the drawing, are disposed on a main body 3 of the X-ray tube 2. To this extent, the construction of the X-ray tube 2 is known in general to one of skill in the art, and will therefore not be explained in detail.

Figure 2:
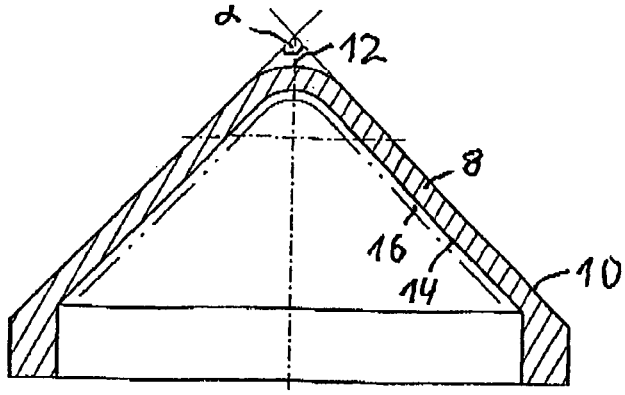
FIG. 2 is an axial cross-sectional view through an inventive target of the microfocus X-ray tube of FIG. 1.
Figure 3:
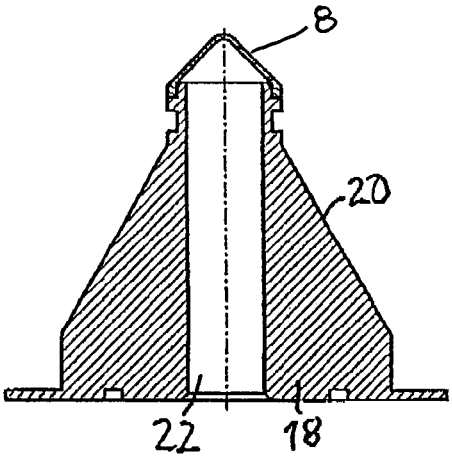
FIG. 3 shows in an illustration comparable to that of FIG. 2, however to a much smaller scale, the target of FIG. 2 with a holder for the target.

Illustrated in FIG. 2 is an inventive target 8 that in this embodiment is made of metal and has an outer surface 10, the cross-section of which, pursuant to the invention, tapers toward the free end of the target 8. In this embodiment, the outer surface is essentially rotationally symmetrical and conical, and terminates in a vertex 12. The conical outer surface 10 of the target 8 has, in this embodiment, an opening angle a of about 45°; however, this angle can be selectable over a wide range in conformity with the respective requirements. In this embodiment, the target 8 is hollow and is provided on its radial inner surface 14 with a thin tungsten coating 16 that during operation of the X-ray tube 2 is bombarded with accelerated electrons, as a result of which X-ray radiation is emitted. In FIG. 3, a holder 18 is illustrated by means of which the target 8 can be connected with the main body 3 of the X-ray tube 2. The holder 18 has an outer surface 20 that tapers conically toward the target 8. The target 8 is connected with the holder 18, and for the connection of the holder 18 with the main body 3 means are provided that are not illustrated in the drawing. The holder 18 has a continuous central channel 22 through which, during operation of the X-ray tube 2, electrons bombard the radial inner surface 14 of the target 8.

Figure 4:
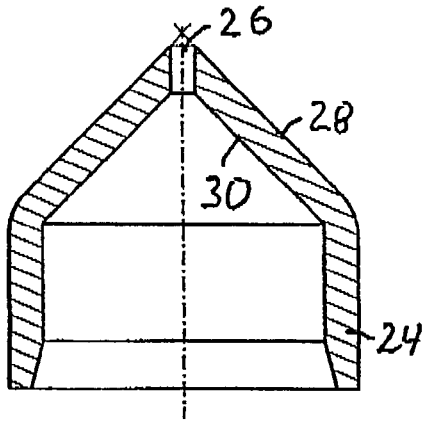
FIG. 4 shows, in an illustration comparable to that of FIG. 2, yet to a somewhat smaller scale, a collimator for the target of FIG. 2.

In FIG. 4, an inventive collimator 24 is illustrated that during operation of the X-ray tube 2, in the direction of the X-ray radiation, is disposed ahead of the target 8 and spatially delimits the X-ray radiation. For this purpose, the collimator 24 has a continuous central opening 26 through which the X-ray radiation is emitted in a spatially delimited manner. The collimator 24 has an outer surface 28 that tapers conically toward its free end, while the radial inner surface 30 of the collimator has a configuration that is essentially complementary to the radial outer surface 10 of the target 8 such that the collimator 24 can be placed in an essentially form-fitting manner upon the target 8.

Figure 5:
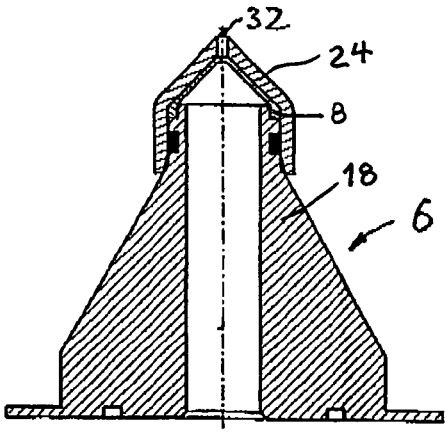
FIG. 5 shows, in an illustration comparable to that of FIG. 3, the head of the microfocus X-ray tube of FIG. 1

FIG. 5 shows the head 6 of the X-ray tube 2 in the assembled state, with the target 8 being placed upon the holder 18, and the collimator 24 being placed upon the target 8. The collimator 24 is fixedly connected with the holder 18, thereby securely holding the target 8 on the holder 18. The unit formed by the target 8 and the holder 18 can be detachably connected with the main body 3 of the X-ray tube 2, so that if necessary it can be easily exchanged or replaced.

During operation of the X-ray tube 2, accelerated electrons pass through the channel 22 and bombard the coating 16 of the target 8, as a result of which X-ray radiation is emitted that is furthermore emitted out of the head 6 of the X-ray tube 2 through the opening 26 in the collimator 24. The free end of the collimator 24 forms a vertex 32 of the head 6.

As illustrated in FIG. 1, the head 6, due to its cross-section that tapers toward its free end, can be brought at an angle to the surface of the component 4 that is to be inspected without the head 6 butting against the surface of the component 4 before a slight spacing of the head 6 from the surface of the component 4 is achieved, which slight spacing is necessary for achieving a greatly enlarged image. To make this evident, illustrated by the dashed line 34 in FIG. 1 is a head of a conventional X-ray tube. One can see that the head of such a conventional X-ray tube would, at an inclined bringing of the head 6 to the surface of the component 4, butt against this surface before the slight spacing of the head from the surface of the head from the surface of the component 4 is reached, which slight spacing can be achieved with the inventive X-ray tube 2 and is necessary for achieving a greatly enlarged image.

The inventive X-ray tube 2 thus enables an inclined bringing of the head 6 up to an extremely slight spacing. Due to the fact that end of the head 6 that is remote from its free end has a considerably greater diameter than does the free end, the inventive X-ray tube 2 has a particularly stable construction. Therefore, there is no danger that the head 6 will become damaged if it butts against raised portions of the component 4 that is to be inspected, as is the case with heads that are known in the state of the art and are embodied as small diameter rod anodes.

The inventive X-ray tube is simple and economical to manufacture.

The use of the collimator 24 is advantageous, although it is not mandatory. If the collimator 24 is omitted, then with the embodiment illustrated in the drawing the conical outer surface of the inventive target 8 forms a conical outer surface of the head 6.

The specification incorporates by reference the disclosure of German priority document 102 51 635.9-33 filed Nov. 6, 2002.

The present invention is, of course, in no way restricted to the specific disclosure of the specification and drawings, but also encompasses any modifications within the scope of the appended claims.

The invention claimed is:

1. A microfocus x-ray tube for inspecting an object, comprising:

a head that during operation of the x-ray tube faces an object that is to be inspected, wherein said head has an outer surface with a cross-section that tapers toward a free end of said head;

a target disposed on or in said head, wherein said target is a transmission target, wherein said outer surface of said head is formed at least partially by said target or by a collimator that in a direction of irradiation is disposed ahead of said target, wherein said target is hollow, and wherein said target terminates in a vertex; and means for forming an electron beam adapted to bombard said target, wherein said means form said electron beam such that said x-ray tube has a focus with a diameter of $\leqq 200$ μm.

2. A microfocus X-ray tube according to claim 1, wherein said focus has a diameter of the $\leqq 10$ μm.

3. A microfocus X-ray tube according to claim 1, wherein said outer surface of said head is essentially rotationally symmetrical.

4. A microfocus X-ray tube according to claim 3, wherein said outer surface of said head is essentially conical.

5. A microfocus X-ray tube according to claim 4, wherein said essentially conical outer surface of said head has an opening angle of less than 50°.

6. A microfocus X-ray tube according to claim 4, wherein said head is provided with at least two regions, disposed one after the other in an axial direction, having different opening angles of the conical outer surface.

7. A microfocus X-ray tube according to claim 1, wherein said outer surface of said head, in a direction of irradiation, is formed at least partially by a holder for said target.

* * * * *